United States Patent [19]

Budinger et al.

[11] Patent Number: 4,494,046

[45] Date of Patent: Jan. 15, 1985

[54] SINGLE CATHODE BEAM MODE FLUORESCENT LAMP FOR DC USE

[75] Inventors: A. Bowman Budinger, Westford; Wojciech W. Byszewski, Arlington; Joseph M. Proud, Wellesley Hills, all of Mass.

[73] Assignee: GTE Laboratories Incorporated, Waltham, Mass.

[21] Appl. No.: 572,600

[22] Filed: Jan. 20, 1984

Related U.S. Application Data

[63] Continuation of Ser. No. 337,047, Jan. 4, 1982.

[51] Int. Cl.[3] ..... H05B 41/16; H05B 41/24

[52] U.S. Cl. ..... 315/260; 313/306; 313/310; 313/599; 313/629; 313/632; 315/334; 315/337; 315/DIG. 1

[58] Field of Search ..... 313/306, 310, 350, 599, 313/629, 632; 315/56, 260, 334, 337, DIG. 1

[56] References Cited

U.S. PATENT DOCUMENTS

| | | | |
|---|---|---|---|
| 1,617,179 | 12/1921 | Smith . | |
| 1,901,128 | 3/1933 | Smith . | |
| 1,943,336 | 2/1934 | Smith . | |
| 2,441,863 | 5/1948 | Zabel | 313/629 |
| 2,946,909 | 7/1960 | Morehead | 313/43 |
| 3,013,169 | 12/1961 | Gungle et al. | 313/43 |

*Primary Examiner*—William L. Sikes
*Assistant Examiner*—Robert E. Wise
*Attorney, Agent, or Firm*—J. Stephen Yeo

[57] ABSTRACT

The lamp shown herein is a beam mode fluorescent lamp for general lighting applications. The lamp comprises a light transmitting envelope, having a phosphor coating on its inner surface, enclosing a single electrode including a thermionic cathode for emitting electrons and an integral anode for accelerating the electrons and forming an electron beam, and a fill material, such as mercury, which emits ultraviolet radiation upon excitation. The electrode configuration provides for use of a single power source and minimal number of power leads. In addition, a separate cathode heater filament is not required.

6 Claims, 1 Drawing Figure

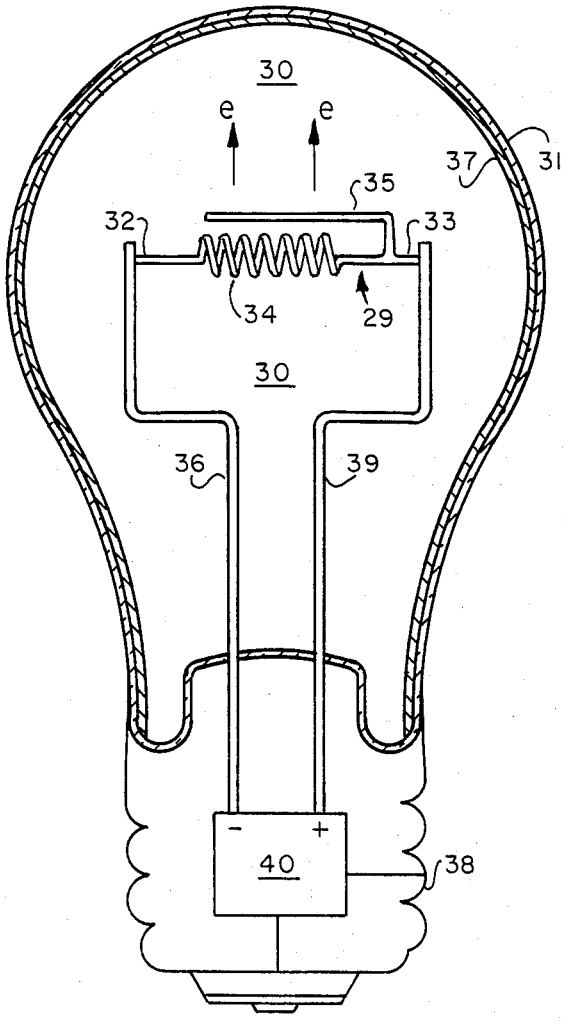
30
e
e
37
31
35
32
33
34
29
30
36
39
-
+
40
38

SINGLE CATHODE BEAM MODE FLUORESCENT LAMP FOR DC USE

This is a continuation of application Ser. No. 337,047, filed Jan. 4, 1982.

CROSS-REFERENCE TO RELATED APPLICATIONS

The present invention is an improvement to co-pending U.S. patent application Ser. No. 219,564, filed on Dec. 23, 1980, for a "Beam Mode Fluorescent Lamp", assigned to the same assignee. The present invention is also related to U.S. patent application Ser. Nos. D23282; D23687; D-23849; D23665 and D24231, all assigned to the same assignee.

BACKGROUND OF THE INVENTION (1) Field of the Invention

The present invention pertains to beam mode discharge fluorescent lamps and more particularly to an arrangement for configuring the electrodes within a beam mode discharge fluorescent lamp.

(2) Description of the Prior Art

U.S. patent application Ser. No. 219,564, filed on Dec. 23, 1980, for a "Beam Mode Fluorescent Lamp", and assigned to the same assignee as the present invention, discloses a particular embodiment of a fluorescent lamp suitable for replacing the conventional incandescent bulb. Although incandescent lamps are inexpensive and convenient to use, they are considerably less efficient than fluorescent lamps.

In the above mentioned patent application, a single anode and cathode configuration is shown. This configuration requires three power terminals connecting the cathode and anode to the two power sources. In an alternate configuration in this application, a four terminal and two power source configuration is shown in which a heating filament is provided to heat the cathode for the production of electrons.

It is desirable to minimize the number of power sources and power connections from the power source to the anode and cathode of the fluorescent lamp. Thereby, the cost of the resulting lamp is less. In addition, such a scheme provides for simpler assembly during manufacture.

Further, grid shaped anodes are taught by the above mentioned application. These anodes are relatively expensive to manufacture and were believed to be necessary to accelerate the primary electrons in the discharge space.

As pointed out in the above mentioned patent application, the placement and location of the anode and cathode is of critical importance.

SUMMARY OF THE INVENTION

Accordingly, it is an object of the present invention to provide a beam mode fluorescent lamp in wich the number of power sources and of power terminals is minimized.

It is a further object of the present invention to provide a beam mode fluorescent lamp which eliminates the need for a wire mesh anode.

The subject beam mode fluorescent lamp includes a light transmitting envelope enclosing a fill material, which emits ultraviolet radiation upon excitation. A phosphor coating on an inner surface of the envelope emits visible light upon absorption of ultraviolet radiation.

A thermionic cathode for emitting electrons is located within the envelope. The cathode is connected to a single DC power source by two conductors, one conductor connected to each end of the cathode. These same conductors also serve to support the cathode at a stationary location within said envelope.

An L-shaped anode is an integral part of the cathode configuration. The anode extends over and parallel to the cathode having a connection to the end of the cathode to which the positive potential of the DC power source is applied. This anode accelerates electrons emitted by the cathode to form an electron beam. The anode is constructed of a simple round wire segment. The anode is spaced apart from the cathode by a distance which is comparable to or somewhat less than the electron range in the fill material. The structure of the anode permits acceleration of the corresponding electron beam with minimum collection of primary electrons due to the anode.

The fluorescent lamp includes a corresponding drift region within the envelope through which the electron beam drifts after passing the anode. Electrons in the electron beam collide with atoms of the fill material in a drift region, thereby causing excitation of a portion of the fill material atoms and emission of ultraviolet radiation and causing ionization of another portion of the fill material atoms thereby yielding secondary electrons. These secondary electrons cause further emissions of ultraviolet radiation. The fill material typically includes mercury and a noble gas, such as neon.

The potential drop betwen the first and second ends of the cathode provides a potential difference between the anode and all points along the cathode except, the end that connects it to the anode. For applications of DC voltage, the anode will be positive with respect to all points along the cathode except the end to which it is connected. This condition will accelerate electrons from the cathode to and past the anode and into the drift region.

The amount of visible light produced by this electrode configuration is substantially the same as that produced with a large wire mesh anode. The instant invention replaces the mesh anode filament structure with a single electrode with an integrated anode-cathode combination. This anode accelerates electrons, while minimizing the amount of electrons collected due to the shape of the anode. In addition, this electrode requires only a single power source and two connecting leads. The power source must convert the incoming AC voltage to DC voltage for use by the lamp.

DESCRIPTION OF THE DRAWINGS

The single sheet of drawings included herewith is a schematic diagram of a single electrode beam mode fluorescent lamp embodying the principles of operation of the present invention.

DESCRIPTION OF THE PREFERRED EMBODIMENT

Referring to the included FIGURE, a single electrode beam mode fluorescent lamp according to the present invention is shown. A vacuum type lamp envelope 31 made of a light emitting substance, such as glass, encloses a discharge volume. The discharge volume contains a fill material which emits ultraviolet radiation upon excitation. A typical fill material includes mercury and a noble gas or mixtures of noble gases. A suitable noble gas is neon. The inner surface of the lamp envelope 31 has a phosphor coating 37 which emits visible light upon absorption of ultraviolet radiation. Also enclosed within the discharge volume by the lamp envelope 31 is an electrode 29 including a thermionic cathode 34 and integral anode 35.

In general, the function of the cathode 34 is to emit electrons, while the function of the anode 35 is to accelerate the electrons emitted by cathode 34, while collecting only a minimal amount of primary electrons. Anode 35 is at the same electrical potential as the end 33 of cathode 34. Anode 35 is L-shaped and extends upwardly relative to cathode 34.

Supporting conductors 36 and 39 provide for electrical connection of the single external power supply 40 through the envelope 31 in a vacuum tight seal, as well as providing support for the electrode structure 29. Conductor 36 connects the negative output and conductor 39 the positive output of power supply 40 to the electrode 29. Cathode 34 is of a thermionic type, requiring 20 to 30 volts DC for operation.

When the electrons have passed anode 35, they enter into a drift region 30 which extends from the anode to the bounds of the enclosing envelope 31.

The lamp further includes a base 38 which is of a conventional type suitable for inserting into an incandescent lamp socket.

During operation, a DC voltage is applied via conductors 36 and 39 to electrode 29, thereby providing for a readily available supply of electrons for discharge by cathode 34. During the application of the DC voltage, a discharge is formed and point 33 is positive with respect to point 32 of cathode 34. As a result, a potential drop exists between points 32 and 33. Anode 35 will accelerate the electrons emitted from cathode 34, since anode 35 is positive with respect to all points along the cathode 34 with the exception of point 33. Most electrons will then pass the anode and into the corresponding drift region 30 as shown. This result is due to the simple round wire segment anode construction vis-a-vis the mesh anode which collects many electrons.

It is to be noted that the cathode heating current and current for developing potential difference between anode 35 and cathode 34 of electrode 29 are derived from the same power supply 40. Only a single power supply and a pair of leads are required for these two functions. Power supply 40 comprises a step-down transformer and a rectifier to produce the required DC voltage, approximately 20 volts.

The spacing of the anode 35 with respect to cathode 34 may be such that it is less than the electron range in the particular fill material to avoid possible current runaway conditions.

As a result, the simple round wire anode is effective to replace the larger mesh anode, while collecting less electrons than the mesh anode.

Although a preferred embodiment of the invention has been illustrated, and that form described in detail, it will be readily apparent to those skilled in the art that various modifications may be made therein, without departing from the spirit of the invention or from the scope of the appended claims.

What is claimed is:

1. A single electrode beam mode fluorescent lamp comprising:

a light transmitting envelope enclosing a fill material which emits ultraviolet radiation upon excitation;

a phosphor coating, which emits visible light upon absorption of ultraviolet radiation, on an inner surface of said envelope;

a single electrode having first and second ends located within said envelope, said electrode including a thermionic cathode and an integral anode;

means for coupling a D.C. voltage between said first and second ends of said electrode with said first end electrically positive with respect to said second end;

said thermionic cathode for emitting electrons in response to said D.C. voltage;

said integral anode for accelerating electrons and forming an electron beam, said anode including a linear conductive wire segment and being L-shaped and connected to said first end of said electrode and extending in spaced relation to said cathode;

a drift region within said envelope through which said electron beam drifts after passing said anode, so that the electrons in said drift region collide with the atoms of said fill material, thereby causing excitation of a portion of said fill material atoms and emission of ultraviolet radiation and causing ionization of another portion of said fill material atoms thereby yielding secondary electrons, said secondary electrons causing emission of additional ultraviolet radiation.

2. A single electrode beam mode fluorescent lamp as claimed in claim 1, wherein said fill material includes mercury, and a noble gas.

3. A single electrode beam mode flourescent lamp as claimed in claim 2, wherein said noble gas includes neon.

4. A beam mode fluorescent lamp as claimed in claim 1, wherein there is further included a lamp base enclosing said power source, whereby said lamp can be operated directly from AC power.

5. A beam mode fluorescent lamp as claimed in claim 4, wherein said power source provides power for heating said thermionic cathode and simultaneously provides a potential difference between said cathode and said integral anode.

6. A beam mode fluorescent lamp as claimed in claim 5, wherein said power source provides a DC voltage in the range of from 20 to 30 volts.

* * * * *